US007566355B2

(12) United States Patent
Gaskins

(10) Patent No.: US 7,566,355 B2
(45) Date of Patent: Jul. 28, 2009

(54) VENT PROTECTOR DEVICE FOR EXHAUST VENTS OF BUILDINGS

(76) Inventor: William Gaskins, 11303 Musket Ct., Fort Washington, MD (US) 20774

( * ) Notice: Subject to any disclaimer, the term of this patent is extended or adjusted under 35 U.S.C. 154(b) by 375 days.

(21) Appl. No.: 11/269,672

(22) Filed: Nov. 9, 2005

(65) Prior Publication Data

US 2007/0101689 A1 May 10, 2007

(51) Int. Cl.
*F24F 7/02* (2006.01)
*F24F 7/06* (2006.01)

(52) U.S. Cl. ..... 55/385.4; 55/DIG. 20; 454/7; 454/18; 454/27; 454/30; 454/184; 110/184

(58) Field of Classification Search ..... 55/385.1, 55/DIG. 20; 454/7, 18, 27, 30, 184, 2, 5; 126/285 A; 110/332–335, 345, 121, 125, 110/163, 175 A
See application file for complete search history.

(56) References Cited

U.S. PATENT DOCUMENTS 2,420,700 A * 5/1947 Curphy ..... 454/5
2,494,016 A * 1/1950 Taylor ..... 454/5
2,508,615 A * 5/1950 Lukes ..... 454/6
2,694,359 A * 11/1954 Jacobson et al. ..... 100/49
3,251,336 A * 5/1966 O'Brien ..... 116/270
3,356,007 A * 12/1967 Clemons et al. ..... 454/5
3,407,720 A * 10/1968 Westerman ..... 454/5
3,788,072 A * 1/1974 Burger ..... 60/324
3,964,376 A * 6/1976 Janke ..... 454/5
4,315,579 A * 2/1982 Martin, Jr. ..... 220/371
4,742,766 A * 5/1988 Davison et al. ..... 454/5
4,770,160 A * 9/1988 Schimmeyer ..... 126/285 A
5,092,226 A * 3/1992 McCloskey ..... 454/5
5,183,435 A * 2/1993 Galvez ..... 454/18
5,267,894 A * 12/1993 Schuck ..... 454/5
5,609,522 A * 3/1997 Szwartz ..... 454/7
6,402,609 B1 * 6/2002 Mangia ..... 454/18
6,592,448 B1 * 7/2003 Williams ..... 454/184

* cited by examiner

*Primary Examiner*—Duane Smith
*Assistant Examiner*—Minh-Chau T Pham
(74) *Attorney, Agent, or Firm*—M.H. Sears Law Firm

(57) ABSTRACT

A device is described which may be fashioned to be installed over an existing unprotected intermittently acting vent pipe of a building, from which malodorous internal air from bathrooms, kitchens, areas where cigar or cigarette smoking ensues and the like, are expelled. It is made from a length of pipe of slightly larger circumference than the existing vent pipe and is stably attached at its lower end to the upper end of the vent pipe. A hinged cap of the same geometric shape as the pipe but of slightly larger dimension is attached at its upper end. Preferably the upper end of this pipe is fashioned so that the pipe rim is not flat but either (1) slants steeply from an upper rim segment on which the hinge of the cap is mounted to a lower rim portion or (2) has two diametrically oppositely disposed high points, from the axis of which the rim slants downward about 15-20 angular degrees in opposite directions with the hinge mounted along said axis and two identical cap portions slanting downward therefrom in opposite directions.

Essentially the same device is made with one uniform length of pipe for places where there is no existing intermittently acting vent pipe. The device in either form prevents ingress to the building of unwanted airborne substances. The device can be rendered weatherproof by adding a hood of substantially greater height and width.

7 Claims, 4 Drawing Sheets

VENT PROTECTOR DEVICE FOR EXHAUST VENTS OF BUILDINGS

INTRODUCTION

The present invention relates to a device effective to shield the interior of a building from the ingress of dust, dirt, pathogenic substances, allergens, insects, moisture and other unwanted airborne substances which substances penetrate through the vent openings made for expelling odors, smoke, fumes, etc by the action of exhaust fans and other similar devices installed in buildings. that must be vented to the outside air.

BACKGROUND OF THE INVENTION

Residential buildings, large and small, today have many vent openings to accommodate the need, e.g., for bathroom air exhaust fans, kitchen range exhaust hoods, attic exhaust fans and other similar devices. Need for installing similar exhaust devices in other types of buildings wherein people work or congregate for purposes of business, entertainment, physical workout, civic and educational pursuits, etc. has led to building codes that almost universally require vent pipes of some nature in virtually every type of building erected or rehabilitated for use today. Little, if any, attention has heretofore been paid to the fact that when vent pipes are not performing their venting purpose, they are open and they intake airborne substances, perhaps because the flow of outside air into an open vent pipe that has no air intake pump or other attached device for immediately replacing exhausted air is deemed negligible, given the many other ways in which air is able to access even the most carefully protected and well built buildings of all types.

The present invention was stimulated by the recognition that for any enclosed structure, open vent pipes are a source of unwanted dust and dirt, moisture, insects, and various irritative, infective and otherwise unwanted agents, followed by a fruitless search for a cost-effective device that is capable of eliminating the effects of leaving these vents open to outside air and unprotected at times when their venting function is not in use.

BRIEF DESCRIPTION OF THE INVENTION

In its simplest form, the present invention consists essentially of a pipe length of slightly larger circumference than the vent pipe, topped by a hinged cover. The pipe length forms a jacket over the open end of the vent pipe and is equipped with a hinged cover at its top end, which cover is blown open by the force of exhausting gas but drops over the pipe length end when no venting is in progress, thereby capping off both the vent pipe and the pipe length jacketing the vent pipe from the external atmosphere. The combination of a pipe length of slightly larger circumference than the vent pipe, a hinged cap and, if needed, one or more set screws (used to assure a snug fit between the vent pipe and the slightly larger pipe length) is referred to hereinafter as a "vent protector". The hinged cap may be fashioned so that its hinge bisects the cap into two half portions, or the hinge may be attached on the outer periphery of the cap.

The pipe section slightly larger than the vent pipe may be fashioned of heavy plastic or stainless steel or other non-rust metal. In the preferred embodiments of the vent protector, the upper end of the pipe length is cut or machined so that it is not level around its circumference, but when viewed from the side is slanted downwardly and the cap is fashioned to slightly overlap the edge of the open pipe all around the pipe circumference.

In more sophisticated embodiments the simplest forms of the vent protector device described above are equipped with a form of hood which is significantly larger than both the vent pipe and the vent protector. The hood includes means for venting gases to the atmosphere and acts to protect the vent pipe and its vent protector from insects, wind, snow, rain, and sleet. Whether or not hooded, the vent protector device also protects the vent pipe from birds and small animals, such as squirrels.

BRIEF DESCRIPTION OF THE DRAWINGS

FIG. 1A is a perspective view of the device about to be lowered over an open vent pipe. FIG. 1B is a side view of the vent protector in closed position, while FIG. 1C is a front view of the same device. FIG. 1D is a close-up top view of the hinged protector cap in closed position.

FIG. 2A is a perspective view of the vent protector positioned above the vent pipe and about to be lowered thereon. FIG. 2B is a side view of this vent protector and FIG. 2C is a front view of this device, while FIG. 2D is a top view of the same vent protector.

FIG. 3A represents the side view of a vent pipe equipped with the vent protector of FIGS. 2A-2D over which an elongated bell shaped hood has been attached, with the vent protector cap in open position to discharge exhausted gases from a building interior. FIG. 3B is a view of the same hooded vent protector pipe with its vent protector cap in closed position and FIG. 3C shows the detail of the backflow plate to the hood which surrounds the vent protector at the base of the hood and acts both to permit outflow of effluent emanations from the vent pipe and also to screen out the ingress of foreign substances from the atmosphere.

FIG. 4A shows a side view of the protected vent pipe enclosed in a drain tube having a mesh of small holes around its periphery to allow draining of vented gases and equipped with a three-tier domed hood. FIG. 4B shows a front view of the same domed hood. FIG. 4C depicts a solid backflow plate encompassing the vent pipe and the vent protects or at the hood bottom.

DETAILED DESCRIPTION OF THE INVENTION

The vent protector of the present invention may be fashioned in any number of shapes, sizes and dimensions. It may be fashioned of any weather resistant material, such as plastic or a non-rust metal such as stainless steel, tin or aluminum.

Basically, in its simplest form it consists of a length of pipe so sized in diameter as to fit over the open end of a vent pipe and, if needed, at least one set screw—and when needed up to 4 such screws—positioned near the lower end of the overfitted pipe length, where they may be tightened to ensure a snug and stable fit with the underlying vent pipe. Any other device capable of ensuring a tight and stable connection of the vent protector to the vent exhaust pipe may be used in place of one or more set screws.

The second necessary component, a hinged cap, is positioned at the vent protector's upper end to act as a cap for both the vent protector and the vent pipe during periods when air is not being exhausted from the vent pipe. When air is being exhausted through the vent pipe, the force of the exhaust pressure blows the cap open and allows escape of the air it is exhausting.

Figure 1D:
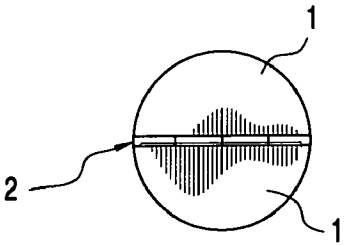
FIGS. 1A, 1B, 1C and 1D illustrate a basic vent protector device of this invention having a central hinged cover device.
Figure 1C:
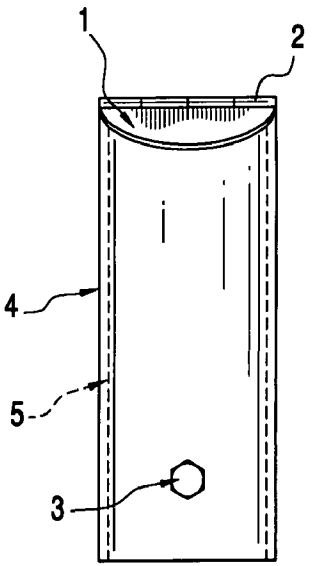

Two types of hinged caps for the upper end of the vent protector are illustrated in the drawings. In FIG. 1D, the cap is a flat circular one, bisected at its center by a hinge which allows both halves of the circular cap to be blown upward by the force of exhausting air. When closed, the halves of the cap preferably angle downwardly over circular downwardly extended cuts in the top of the protector pipe and slightly overlap the rim of the pipe. This construction feature, which is visible in the side view drawing 1B and the front view drawing 1C, as well as in the perspective drawing 1A wherein the vent protector is open and in position to exhaust air, is preferred because it affords better protection against tampering by animals or birds than a cap-conduit relationship wherein the conduit top is horizontally aligned around its periphery and the cap fits over it, in a horizontal relationship. The cap may be made of any relatively lightweight material, such as a durable lightweight plastic, a lightweight, non-rust, metal such as tin or aluminum, etc. The hinge and its pin are stainless steel or other rustproof durable material.

Figure 2D:
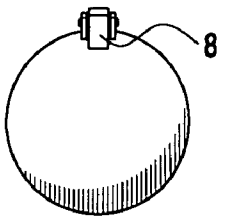
FIG. 2A, 2B, 2C, and 2D illustrate another form of the basic vent protector wherein the protective device has a one-piece cover hinged at the uppermost point of the device.
Figure 2C:
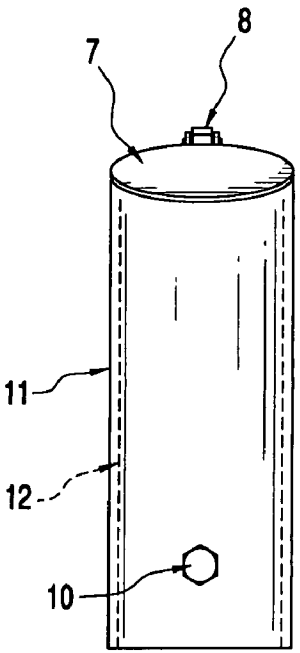
Figure 2B:
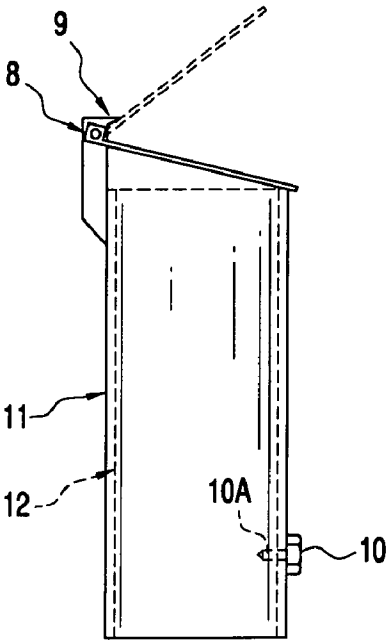
Figure 2A:
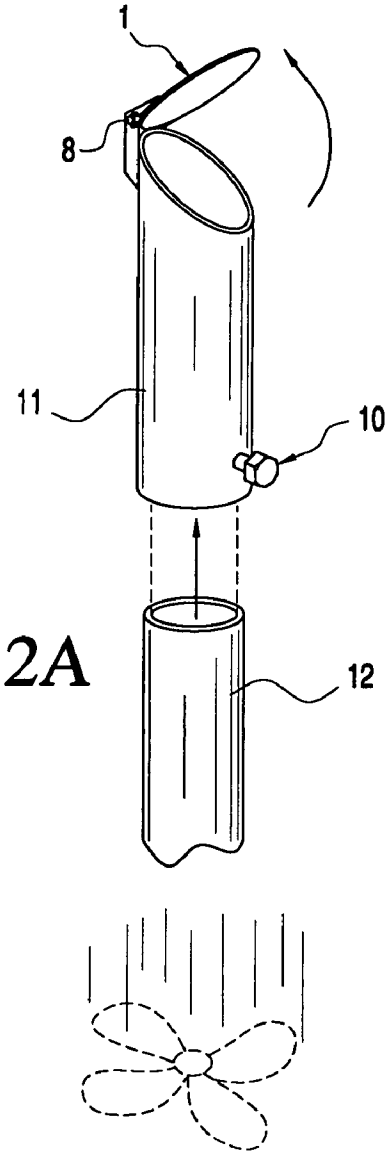

An alternative form of valve is depicted in FIG. 2D wherein the vent protector is fashioned with a top opening which is not horizontally aligned around its periphery, but rather, when viewed from the side, it is canted at an angle with the hinge of the cap mounted at the highest point, as is visible in the perspective drawing, FIG. 2A, and also in the side view, FIG. 2B. So positioned, the cap; when closed, rests at an angle and extends downwardly from the hinge to rest upon and slightly overlap the downwardly slanted rim of the vent protector. While this is a preferred construction of the vent protector when it is equipped with a hinge mounted on a part of the cap circumference, it is also within the scope of this invention to attach a hinged cap to an upper, flat, horizontally disposed, even rim of a vent protector. The vent protector top which is angled from an upper high point downward to an opposite lowest point on the upper periphery of the vent protector is preferred because it is less easily manipulatable from the exterior into an open position by birds and small animals, such as squirrels, etc. and it helps in encouraging rapid runoff of water, snow, etc. and preventing accumulation of such substances around.

Both types of cap are fashioned so that they overlap the rim of the vent protector pipe slightly when in closed position, and thereby provide protection from rain, snow, sleet, insects and wind-borne detritus so long as the vent protector pipe is in closed position, as well as encouraging runoff of moisture in all states.

Figure 1B:
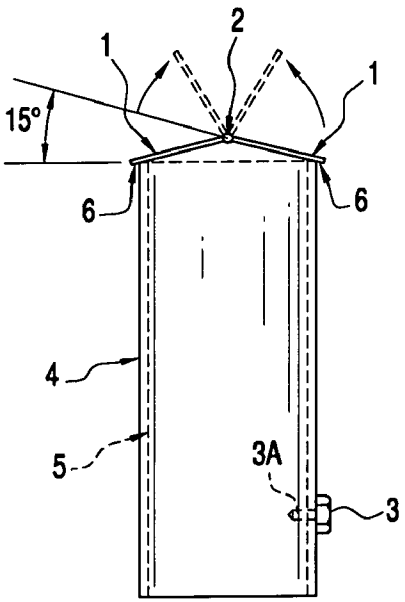
Figure 1A:
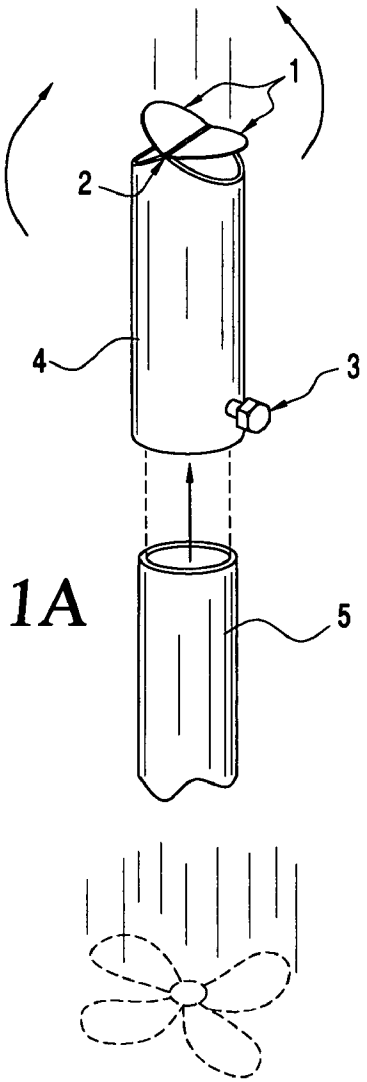

FIGS. 1A-1D inclusive and 2A-2D inclusive, respectively, show the two preferred versions of the simplest form of the vent protector device of this invention. In each of FIGS. 1A, 1B, 1C, and 1D the integers 1 denote the two halves, or flaps of the vent protector cap, the integers 2 refer to the hinge which is equipped with a hinge pin, the integers 3 denote a set screw, and 3A refers to the tip of the set screw that extends into the partially enclosed vent (or "exhaust pipe"). Integers 4 identify the exterior of the vent protector pipe and integers 5 refer to the vent or exhaust pipe itself. In FIG. 1B the integers 6 refer to the overlap between the cap and outer wall of the vent protector pipe.

In each of FIGS. 2A, 2B, 2C, and 2D integers 7 refer to the unitary vent protector cap, integers 8 denote its hinge and hinge pin assembly, and integer 9 is a lid stop attached behind and extending above the hinge for the purpose of preventing the cap from extending so far backward when in open position that it does not immediately close when free of exhaust pressure from the vent pipe. Integers 10 represent a set screw in these drawings and 10A refers to the set screw tip which extends through and into the exhaust pipe. In these drawings 2A-2D inclusive, further, the integers 11 denote the outer wall of the vent protector pipe while integers 12 refer to the exhaust or vent pipe itself.

As will be readily understood, the preferred versions of the device depicted in FIGS. 1A-1D inclusive and FIGS. 2A-2D inclusive are particularly designed to be fitted over pre-existing vent pipes on a building. It is contemplated that vent protector pipes within the scope of this invention can readily be designed to mate with vent pipes such that both might be installed simultaneously in buildings under construction or to be constructed. Such prefitted vent pipe-vent protector combinations can, e.g. be provided with mated opposing threads that can be firmly screwed together and will act to hold the two pipes in snug, stable relationship in lieu of using set screws for that purpose. Alternatively, a single pipe properly equipped with a hinged cover may be installed to provide both venting and vent protection functions. Many other modifications can readily be made to afford both functions to an exhaust fan venting system without departing from the scope of this invention, as will be readily apparent to those of ordinary skill in the art.

Figure 3C:
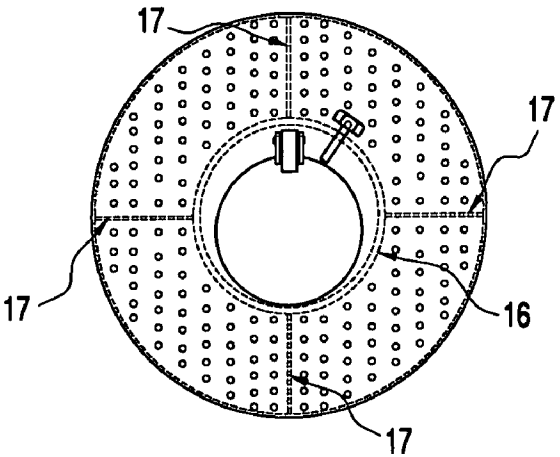
FIGS. 3A, 3B, and 3C show a hooded vent protector of the type shown in FIGS. 2A-2D inclusive. More particularly.
Figure 3B:
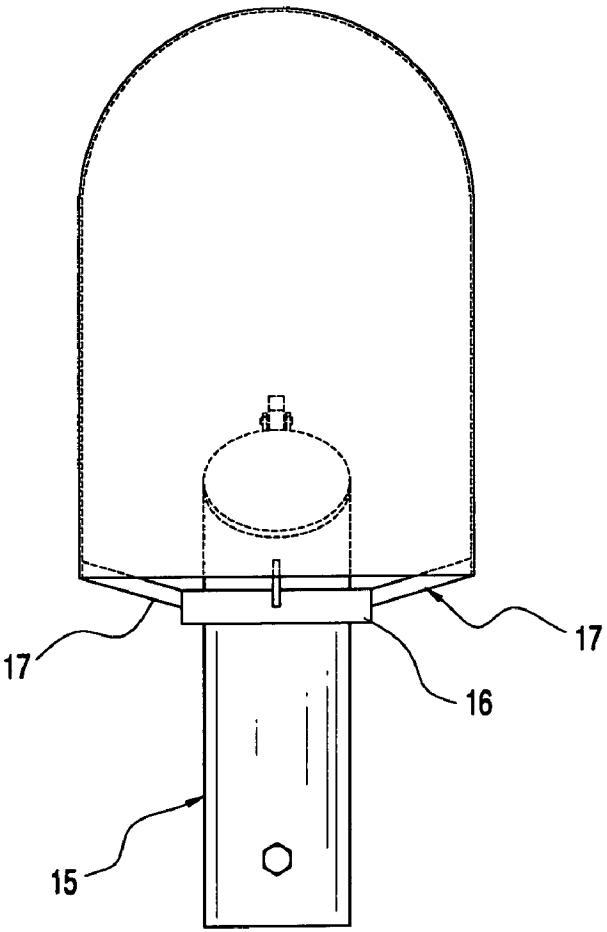
Figure 3A:
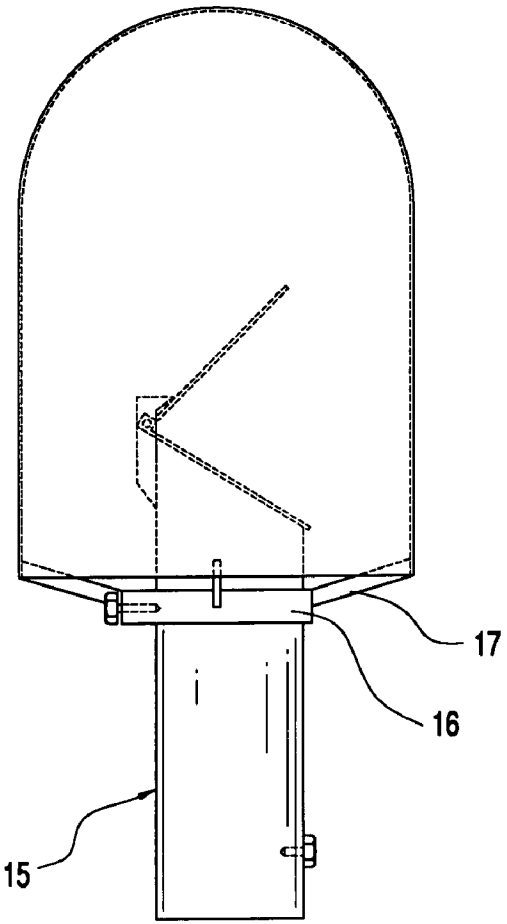
Figure 4C:
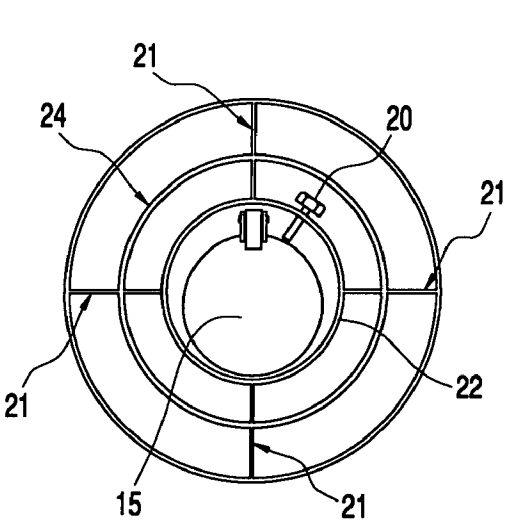
FIGS. 4A, 4B, and 4C depict a hooded variation of the vent pipe equipped with a vent protector as shown in FIGS. 2A-2D inclusive.
Figure 4B:
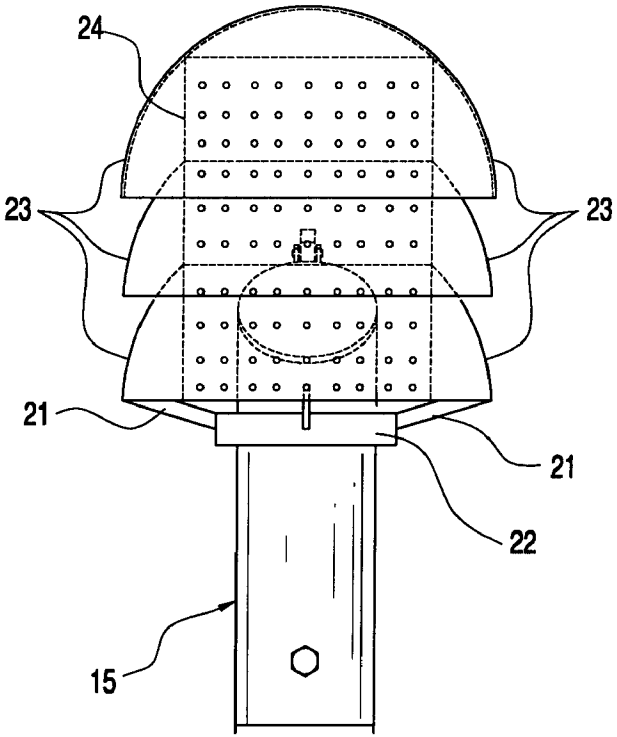
Figure 4A:
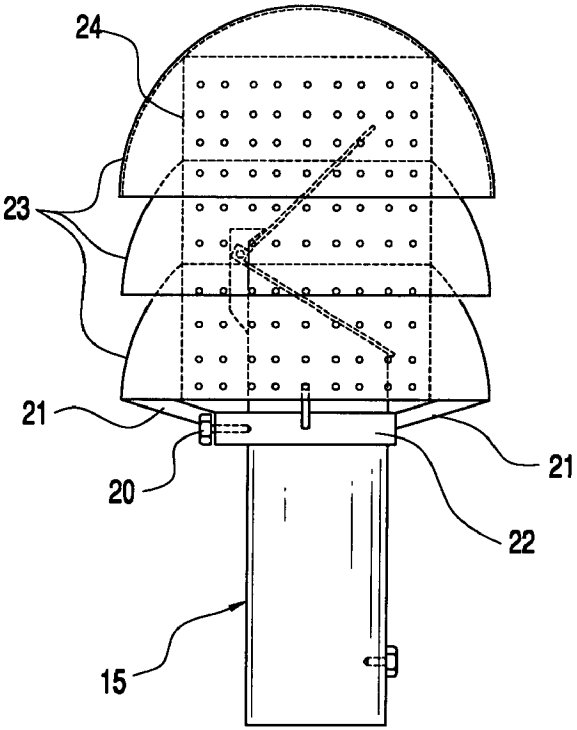

The basic vent protector is rendered more reliably weather proof by equipping it with a hood of the type depicted in FIGS. 3A-3C inclusive or that of FIGS. 4A-4C.

Both types of hood can be used with the basic vent protector of FIGS. 1A-1D inclusive or that of FIGS. 2A-2D inclusive. Here both are shown with the basic vent protector of FIGS. 2A-2D.

The hood in each instance is a relatively large piece, in height and breadth, in relation to both. the vent pipe and the vent protector which jackets the vent pipe. The hood is attached to the upper end of the vent protector pipe by a sleeve from which at least two support arms extend outward to the bottom periphery of the hood itself. The sleeve may be attached to the vent protector by means of one or more set screws or in any other manner that insures a secure, stable connection between the two. Just above. the support arms the hood is equipped with a backplate designed to fit around and completely surround the sleeve that is fitted around the vent protector pipe and to extend out in its outer dimensions so as to fit the bottom of the inner wall of the hood. The backplate may be perforated as shown in FIG. 3C or if the hood is equipped with a drain tube as shown in FIGS. 4A, B, and C then the backplate is constructed as shown in FIG. 4C so that the space between the sleeve and the drain tube is unobstructed at the bottom but the space between the drain tube and the inner wall of the hood's lowest tier is covered by a solid, ring-shaped backplate of metal or plastic. The backplate of FIG. 4C, when in place, is impervious to both the outgoing emanations exhausted from the underlying building and substances in the external atmosphere of the nature of those that routinely enter buildings when exhaust vent pipes are uncapped.

With specific reference to FIGS. 3A-3C, a hood is depicted which may be constructed of lightweight, rustproof metal or of an impermeable plastic such as polyvinyl chloride. In this set of figures, the integers 15 denote the outside of a vent protector pipe, intergers 16 refer to the sleeve and integers 17 refer to support arms.

FIG. 3A shows the hooded vent protector pipe enclosed by the hood while the vent protector is in open exhaust mode with its hinged cap open. In FIG. 3B the hinged cap of the vent protector pipe is closed. FIG. 3C shows a view of the backplate as it would appear if one could look down from just above the closed cap of the vent protector tube. In this view the sleeve 16 surrounds the capped vent protector pipe, the support arms 17 just beneath the backplate appear and the perforations in the backplate which permit drainage of exhausted air from the building appear.

FIGS. 4A, B and C show another type of hood arrangement attached to the vent protector—vent pipe assembly of FIGS. 2A-2D inclusive. In this embodiment, the hood is a 3-tiered series of dome-like members which encompass a drain tube that extends around the circumference of the vent protector/vent pipe assembly. As can be seen in FIGS. 4A-C inclusive, the drain tube has small holes over its entire surface through which building effluents exhausted through the vent pipe and vent protector are expelled to the atmosphere. The 3-tiered hood insures that the drain tube is protected from insects, birds and small animals, weather effects such rain, snow sleet and other forms of moisture, wind effects and windblown debris, including dust and dirt, etc. Because the backplate of this hood arrangement consists of a solid ring of metal or plastic, any unwanted exterior moisture or other material that does penetrate past the hood is trapped there and cannot pass into the vent protector top when the cap is in open position.

Turning to FIGS. 4A-4C inclusive, it can be seen that the hood is attached to the vent protector tube 15 with one or more set screws 20 and support arms 21 which are connected to the sleeve 22. Each of the top tiers 23 of the hood is open at the bottom to enable effluents from the building to be expelled through the drain tube 24; the bottom tier 23 is partially closed off by the backplate which is shown in cross section in FIG. 4C. FIG. 4B represents the same arrangement as FIG. 4A from the front perspective with the cap of the vent protector closed. FIG. 4A, as can be seen, shows a side view of the hooded vent protector—vent pipe assembly with the cap of the vent protector in the open position that is automatically created by the pressure that exhausts airborne odors and other effluents from a building, FIG. 4C shows the backplate employed with the type of hood plus drain tube arrangement of FIGS. 4A and 4B. As can be seen in this figure, the circular shaped drain tube has a circumference substantially greater than that of the vent protector pipe, and the backplate is in the form of a solid ring of rustproof metal or plastic.

As has been noted above, the embodiments of vent protector and hooded vent protector specifically exemplified herein have been devised with particular reference to protecting the vent pipes that presently are in place on existing buildings. In devising vent-protected arrangements for buildings not yet completed or still to be built, it is not only contemplated that units wherein vent pipes of the type now in use may be matched with vent protector units featuring pipe of larger circumference with both units reciprocally threaded to enable them to be screwed together, but it is envisioned that unitary vent pipes extended in length to a moderate degree over those presently in use may be equipped with hinged cap arrangements of either type herein disclosed and depicted and that preferably the tops of such pipes will be fashioned to allow the capping of the arrangement to take place in a slightly downwardly inclined direction, of the order of about 15-20 degrees from horizontal with the cap slightly overlapping the rim of the pipe when in closed position.

It is further envisioned that the shapes of the hoods depicted herein could be modified; for example, either or both versions could easily be adapted to have a generally conical rather than a generally rounded shape.

Because it is apparent that many modifications of the invention herein disclosed can readily be made without departing from the invention, it is intended that the scope of the invention be limited only by the appended claims.

I claim:

1. A device for protecting an existing, intermittently acting, external vent pipe of a building from the ingress of foreign airborne substances present in external atmospheric air, which device comprises (a) a length of pipe having a slightly larger circumference than said vent pipe so that it fits over the upper end thereof, to which upper end it is stably connected at its own bottom end, (b) and at its own upper end is provided with a hinged cap, which cap automatically (i) opens fully when air is being exhausted through said vent pipe and automatically closes fully upon cessation of such air exhaustion, and (ii) is of the same geometric shape as the cross section of said length of pipe, but is slightly larger than said cross-section in all its dimensions, whereby its rim overhangs the rim of said length of pipe when said hinged cap is in its fully closed position.

2. A device according to claim 1 wherein said length of pipe has been so fashioned at its terminal upper end that its upper rim portion slants steeply downward to a lower rim portion when it is viewed in perspective and the hinge of its hinged cap has been mounted upon said upper rim portion so that said cap closes on a downward slant.

3. A device according to claim 1 wherein said length of pipe has been so fashioned at its terminal upper end that midway of its periphery there are two diametrically opposed high points from which its periphery slants downwardly in opposite directions to positions, each about 15 to 20 angular degrees below said high points, and (i) the hinge of said cover is situated on a diameter of said cap and (ii) is mounted along the axis of said two high points, whereby said hinged cover is bisected by its hinged portion to form two identical cover portions slanting downward from said axis and overhanging the rim of said length of pipe in opposite directions when said cover is in the closed position.

4. A device capable of acting both as (1) an external intermittently acting vent pipe for a building and (2) to prevent ingress into said building of foreign substances present in external atmospheric air, which device comprises a suitable length of pipe capable of being connected within said building to areas in need of venting and having a terminal upper end located exterior to the building, which terminal upper end is provided with a hinged cap as described in (b) part of claim 3.

5. A device according to claim 4 having a terminal upper end provided with a hinged cap as described in claim 2.

6. A device according to claim 4 having a terminal upper end provided with a hinged cap as described in claim 3.

7. A device for rendering impervious to the effects of frozen precipitation, subfreezing temperatures and contacts with external wildlife, an intermittently acting external vent pipe of a building, which vent pipe (i) which acts to expel fully from one or more interior regions of said building unwanted fumes and odors and (ii) has been equipped automatically to fully close off external air from entering said building during periods when expulsion of effluents therefrom is not occurring, which device comprises:

(a) a circular backplate of substantially larger diameter than said vent pipe which backplate (i) has a central opening sized to fit snugly over said vent pipe, (ii) is securely fastened to said vent pipe and (iii) is characterized by the presence throughout its surface area of a number of small, evenly spaced perforations which enable external air to pass through them and (b) an upwardly extending, elongated, essentially bell-shaped hood member, the sidewalls of which extend a substantial distance above both (i) the upper end of said vent pipe and (ii) the entire surface of said backplate, which member is securely fastened at its bottom end to said vent pipe and said circular backplate, whereby said circular backplate and said essentially bell-shaped hood member coact to shield said vent pipe from (1) freezing or becoming clogged with ice, snow or sleet and (2) from coming into contact with birds, small animals and all insects incapable of moving upward through the small evenly spaced perforations of said backplate.

* * * * *